United States Patent [19]

Raiskums et al.

[11] Patent Number: 4,840,689

[45] Date of Patent: Jun. 20, 1989

[54] ORNAMENT PRODUCTION

[75] Inventors: Olaf B. Raiskums, Brampton; James D. Mancel, Aurora, both of Canada

[73] Assignee: Raiman Design, Inc., Wilmington, Del.

[21] Appl. No.: 207,578

[22] Filed: Jun. 16, 1988

[51] Int. Cl.[4] ..... B31F 1/00

[52] U.S. Cl. ..... 156/217; 156/227; 156/264; 156/443; 223/46; 493/955

[58] Field of Search ..... 223/46; 156/443, 226, 156/227, 475, 217–218, 264; 493/955

[56] References Cited

U.S. PATENT DOCUMENTS

| | | | |
|---|---|---|---|
| 3,139,225 | 6/1964 | Rector | 223/46 |
| 3,143,259 | 8/1964 | Paar | 223/46 |
| 4,661,197 | 4/1987 | Mancel et al. | 156/443 |

*Primary Examiner*—David Simmons

*Attorney, Agent, or Firm*—Panitch Schwarze Jacobs & Nadel

[57] ABSTRACT

A method and apparatus is disclosed for producing gift wrap ornaments of the type having a plurality of radiating conical points. The ornament is produced by cutting from a continuous strip of flexible material, a continuous strip of longitudinally spaced-apart blanks, each blank having transversely opposed petals and a central portion therebetween. The petals are formed into cones to produce a string of elements having opposed cones. These elements are separated, a plurality of them are stacked in a circular arrangement and the central portions of the elements are compressed and stapled together to form the ornament.

26 Claims, 7 Drawing Sheets

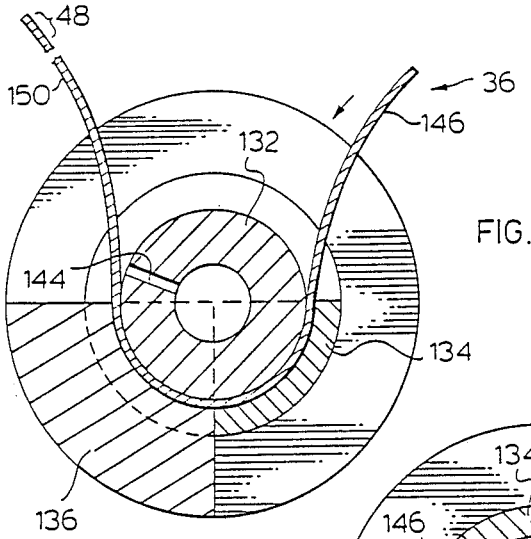
FIG.10.
FIG.11.
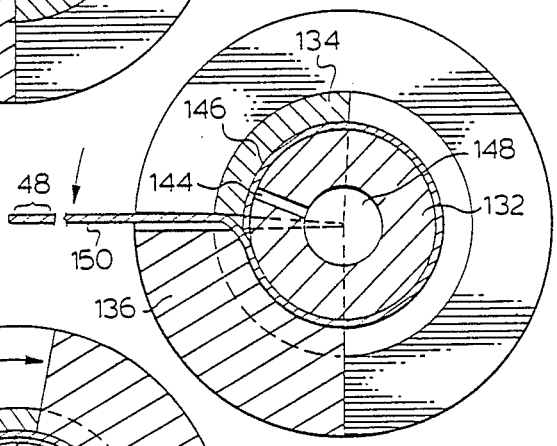
FIG.12.
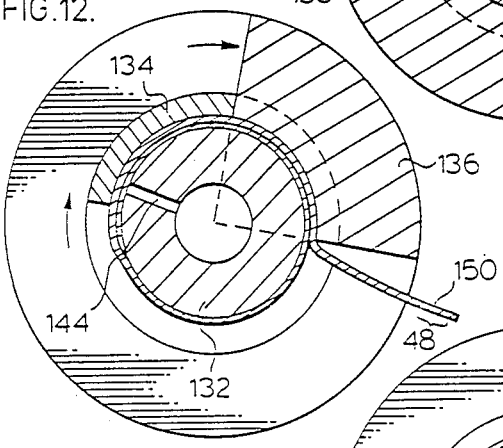
FIG.13.
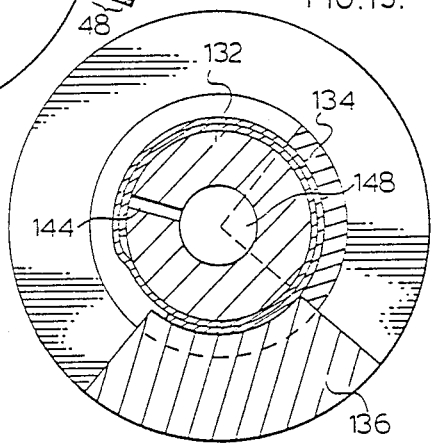

ORNAMENT PRODUCTION

BACKGROUND OF THE INVENTION

1. Field of the Invention

This invention relates to a method and apparatus for producing gift wrap ornaments of the type having a plurality of radiating conical points.

2. Description of the Prior Art

The most common type of gift wrap ornament on the market today is the conventional ribbon bow. These bows are either hand made or machine made, the latter being the most common. While these bows are aesthetically pleasing, there is a need for something different in this field. An answer to this need is an ornament having a plurality of radiating conical elements by the inventors hereof and shown in U.S. Pat. No. 4,661,197 issued Apr. 28, 1987. This patent relates to a method and apparatus for producing such ornaments, and although this method and apparatus is suitable for the purpose, the present invention is an improvement thereon whereby the subject ornaments can be made much faster and more cheaply than was previously the case.

STATEMENT OF INVENTION

In the present invention, a totally different type of blank is used to form the conical elements or points. These elements are formed in a continuous strip, which enables a plurality of conical points to be formed simultaneously, thus vastly increasing the rate of production.

According to one aspect of the invention, there is provided a method of producing a hemispherically-shaped ornament having a plurality of radiating conical points. The method comprises the steps of providing a strip of flexible material, cutting out of the strip a strip of longitudinally spaced-apart blanks, each blank having transversely opposed petals and a central portion therebetween. The petals are formed into cones to produce elements with opposed cones. The elements are separated and a plurality of the elements are stacked in a circular arrangement. The central portions are then compressed and connected together to form the ornament.

According to another aspect of the invention, there is provided apparatus for producing ornaments having a plurality of radiating conical points. The apparatus comprises a cutter for cutting a strip of longitudinally arranged blanks from a supply of thin flexible material, the blanks each having transversely opposed petals and a central portion therebetween. A winder having a conical bed is adapted to be located below the petals. A retractable conical form is adapted to mate with the winder conical bed with a petal therebetween. An adhesive applicator is located before the winder for applying adhesive to the petals. A means is provided for rotating the winder about the conical form to form the petals into cones. Means is provided for cutting the continuous strip into elements with opposed cones. A stacker is provided for assembling a plurality of these elements into a circular arrangement with the central portions along a common axis. Also, a fastening device is provided for connecting together the central portions of the elements.

BRIEF DESCRIPTION OF THE DRAWINGS

A preferred embodiment of the invention will now be described with reference to the accompanying drawings, in which:

FIGS. 10, 11, 12 and 13 are enlarged sectional views taken along lines 10—10 of FIG. 8 showing sequential stages of a petal being formed into a cone;

DETAILED DESCRIPTION OF THE PREFERRED EMBODIMENTS

Figure 1:
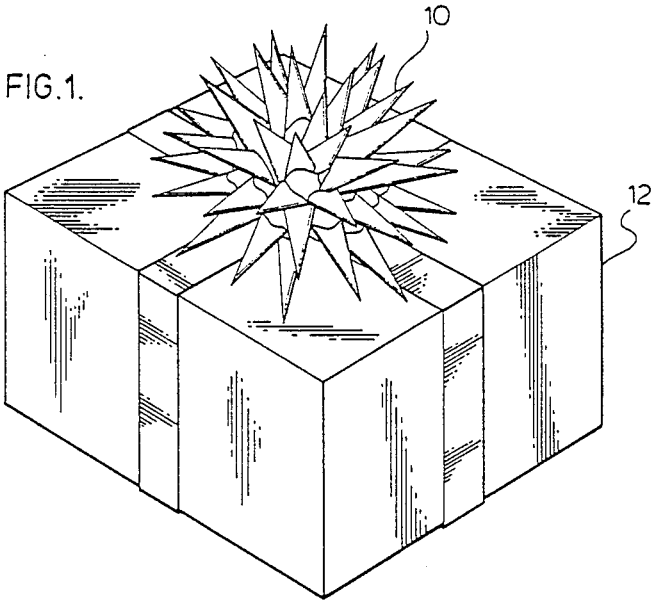
FIG. 1 is a perspective view of a typical gift bearing an ornament of the type made by the present invention.

Referring firstly to FIG. 1, an ormanent 10 produced by the method and apparatus of the present invention is shown mounted on a typical gift 12.

Figures 4, 5, 6:
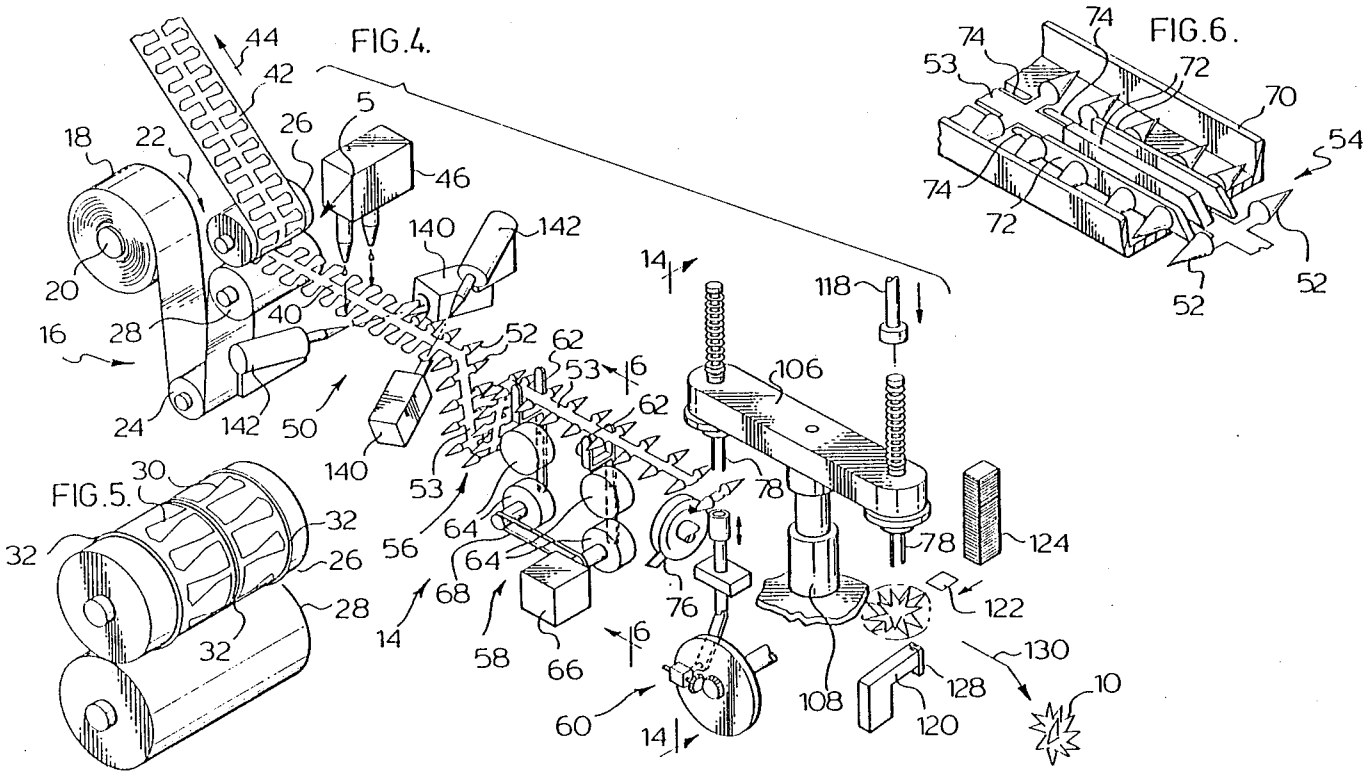
FIG. 4 is a perspective diagrammatic view of a preferred embodiment of the apparatus used to make the ornaments of the present invention.
FIG. 5 is a perspective view of the die cutter looking in the direction of arrow 5 in FIG. 4.
FIG. 6 is a perspective view taken along lines 6—6 of FIG. 4 with structure added that was deleted from FIG. 4 for the sake of clarity.

Referring next to FIGS. 2 through 6, a preferred embodiment of the apparatus for producing ornaments 10 is generally indicated by a reference number 14. Apparatus 14 includes an unwind station 16 for feeding a continuous strip of flexible material, such as paper, to apparatus 14. For this purpose, a roll of paper 18, typically about 14 to 16 centimeters in width is mounted on a spindle 20 to unwind in the direction of arrow 22. Paper 18 passes around a tensioning dancer roll 24 and is then fed into a die cutter consisting of a die cutter roll 26 and an anvil roll 28 as best illustrated in FIG. 5. Die cutter roll 26 is a rotary die cutter having opposed, spaced-apart blades 30 and gripping O-rings 32 which grip the paper and maintain the pitch between successive blanks as the continuous strip is pulled through the die cutter. Anvil roll 28 is a case hardened steel roll of the type typically used in rotary die cutters.

Figure 2:
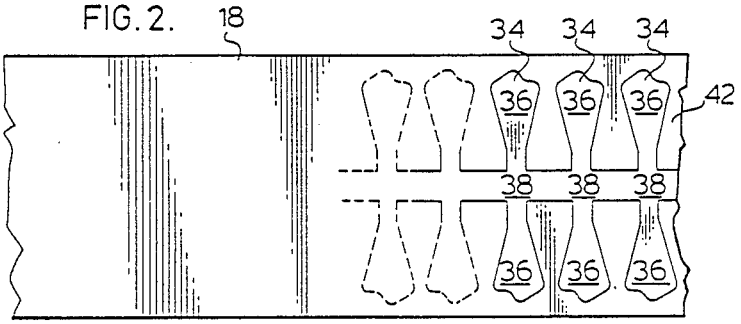
FIG. 2 is a plan view of a portion of a continuous strip showing how the blanks are cut therefrom.
Figure 3:
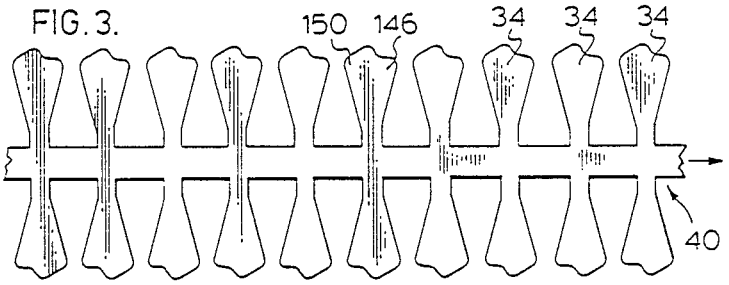
FIG. 3 is a plan view of a length of the continuous strip of blanks.

Referring for a moment to FIGS. 2 and 3, the continuous strip of paper 18 is shown in FIGS. 2 as it would be in the process of being passed through die cutter rolls 26, 28. The die cutter rolls cut out of paper strip 18 a continuous strip of longitudinally spaced-apart blanks 34, each blank having transversely opposed petals 36 and a central portion 38 located therebetween. Blanks 34 are typically 12 to 14 centimeters in width, and the spacing between blanks 34 is such that as a continuous strip of blanks 40 is cut from paper 18 as indicated in FIG. 3, a continuous strip of scrap 42 (see FIG. 4) is formed. For this purpose, blanks 34 should be as close together as possible to minimize the amount of scrap, and yet enable the continuous strip of scrap 42 to be removed as indicated by arrow 44 in FIG. 44 without the strip of scrap 42 being pulled apart or broken.

Figure 7:
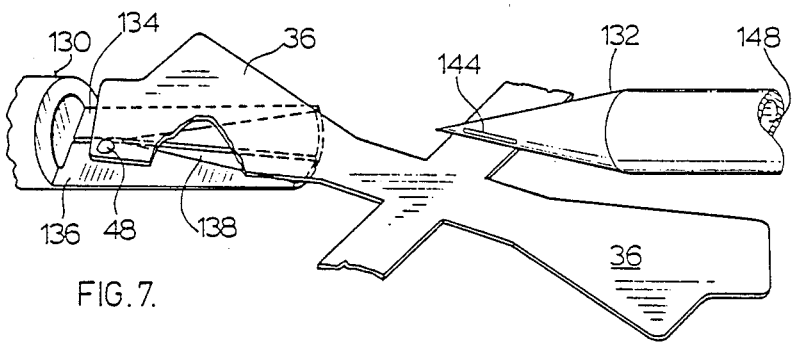
FIGS. 7, 8 and 9 are enlarged perspective views of a cone former in operation in partially completing a cone on a blank.
Figure 9:
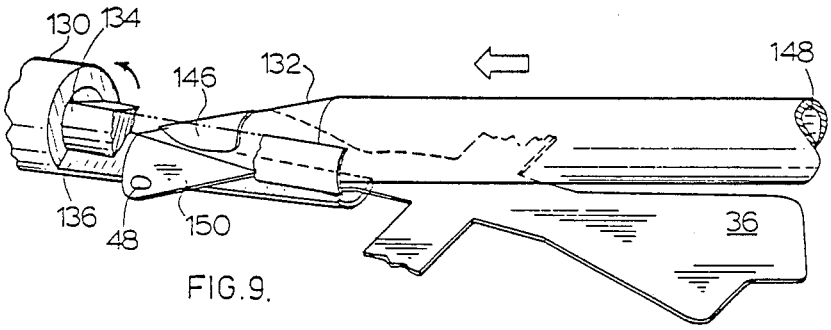

Referring again to FIG. 4, as the strip of blanks 40 passes out of die cutter rolls 26, 28, the petals of each blank pass under an adhesive applicator 46 which applies a drop of adhesive 48 to each petal as best illustrated in FIGS. 7, 9 and 10. The strip of blanks 40 then passes through a cone forming station 50 where petals 36 are formed into cones 52. As will be described further below, petals 36 are formed into cones by successively wrapping the petal sides or edges in opposite directions around a conical form. The adhesive is applied to the second or trailing edge of petal 36 so that the adhesive is between overlapping petal material.

Figure 15:
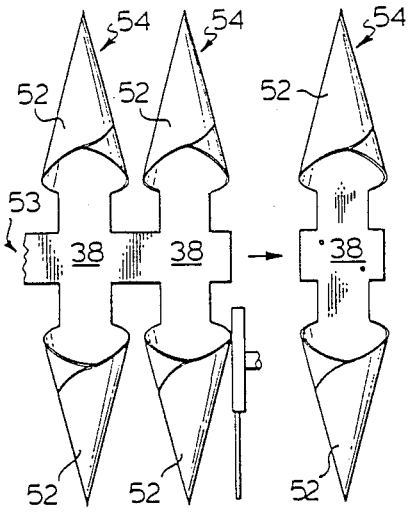
FIG. 15 is a plan view showing a leading element being cut from the continuous strip of elements.

Once cones 52 are formed, strip 40 is now in the form of a continuous strip 53 of elements 54 having opposed cones 52 as best illustrated in FIG. 15.

The strip of blanks 40 is moved through cone forming station 50 by a chain conveyor (not shown), which moves the strip of blanks 40 a certain distance and stops while the cone forming station forms cones 52, and then moves strip 40 again a certain predetermined distance or length while the next set of cones 52 is formed. Actually, a plurality of cones 52 are formed simultaneously on each side of strip 40 as will be described further below. However, it is because strip 40 undergoes this stop and start movement that dancer roll 24 is required to maintain an even tension in strip 40.

As the continuous strip of elements 53 passes out of cone forming station 50, it goes through a take-up loop 56 and then passes into a feed station 58, which feeds strip 53 into a stacking and stapling station 60. Feed station 58 includes two sets of fingers 62 eccentrically mounted on co-rotating drive wheels 64 all driven simultaneously by a suitable drive 66 and timing belt 68. It will be appreciated that as drive 66 causes drive wheel 64 to rotate, fingers 62 walk element strip 53 toward stacking and stapling station 60, one pair of fingers 62 always being in contact with one of the elements 54 to maintain the drive tension in strip 53.

FIG. 6 shows the actual means for guiding strip 53 through feed station 58, this structure having been omitted from FIG. 4 for the purposes of clarity. The FIG. 6 guide means includes a channel 70 upon which strip 53 slides and three guide rails 72 located just above the floor of channel 70 so that strip 53 slides between channel 70 and guides rail 72. Channel 70 is formed with elongate slots 74 and fingers 62 poke up through these slots to engage elements 54 and move them along toward stacking and stapling stations 60.

Figure 14:
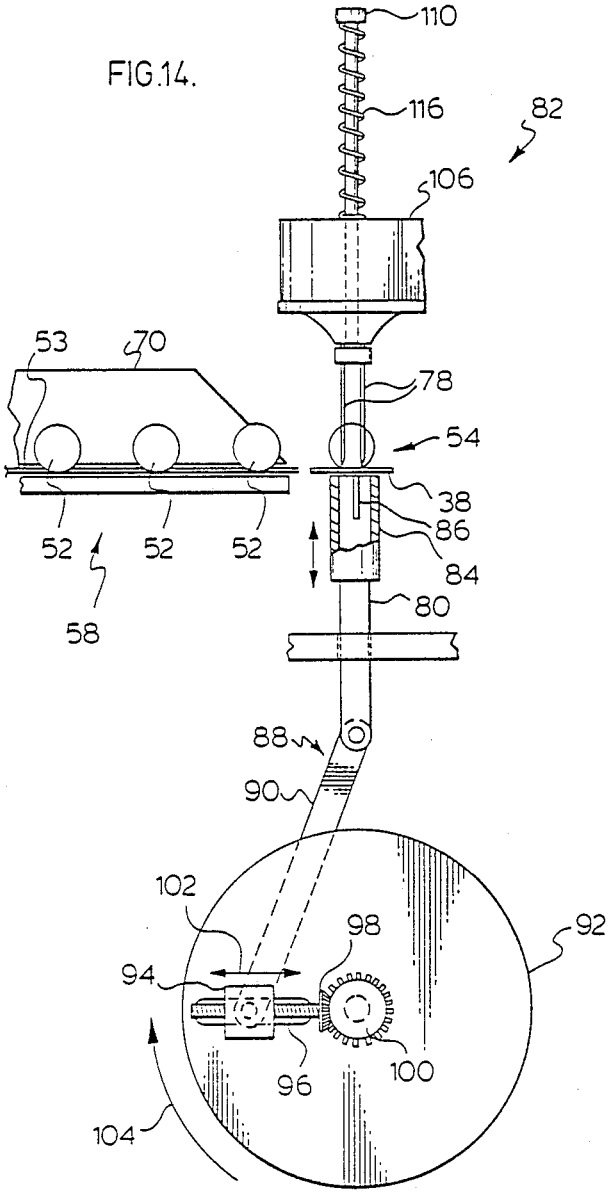
FIG. 14 is an enlarged elevational view taken along lines 14—14 of FIG. 4.

Referring in particular to FIGS. 4, 14 and 15, the stacking portion of stacking and stapling station 60 will now be described. First, as the continuous strip of elements 53 passes out of feed station 58, the individual elements 54 are separated by a rotary knife 76. Simultaneously with knife 76 cutting strip 53, the central portion 38 of a leading element 54 is engaged by a rotatable pair of spaced-apart, parallel pins 78 and a pusher 80 which moves upwardly to push element 54 onto pins 78 causing the pins to pierce central portion 54. The severed element 54 is now engaged by a stacker 82 which stacks a plurality of elements 54 in a circular arrangement in the following manner. As the leading element 54 is pushed under pins 78, pusher 80 moves upwardly to push the first element 54 onto pins 78. Pusher 80 includes a hollow cylindrical head 84 having a thin splitter 86 which supports central portion 38 as the pins 78 pierce it. Head 84 is reciprocated by a crank mechanism 88 having a connecting rod 90 attached eccentrically to a rotating drive wheel 92 through a pivoting threaded connector 94 mounted on a screw threaded element 96 driven by a pinion 98 in mating engagement with a stationary bevel gear 100. It will be appreciated, therefore, that as drive wheel 92 rotates, connector 94 moves in the direction of arrows 102 causing the stroke of pusher 80 to vary. Connector 94 starts in the most outward position giving pusher 80 the maximum stroke as the first element 54 is pushed into pins 78, and as drive wheel 92 rotates in the direction of arrow 104, connector 94 moves inwardly shortening the stroke of pusher 80, and in this way successive of elements 54 are spaced vertically along pins 78. This variable drive for decreasing the travel of pusher 80 prevents the cones 52 of elements 54 from bunching up or being crushed as the successive elements 54 are stacked onto pins 78.

Figure 16:
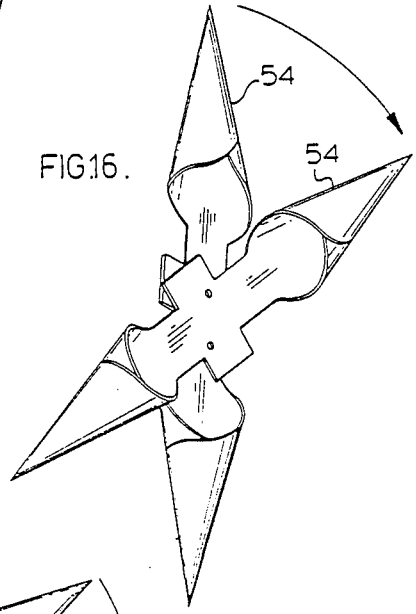
FIGS. 16 and 17 are respective perspective and plan views showing the steps of rotating and stacking a plurality of elements.
Figure 17:
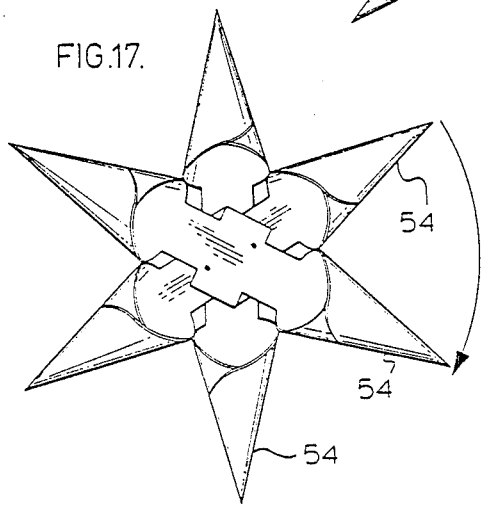

Stacker 82 includes a housing 106 which has mounted therein a stepping motor drive (not shown) for rotating the pair of pins 78 a predetermined amount before each successive element is pushed onto pins 78. FIGS. 16 and 17 illustrate this successive rotation, and while FIG. 17 shows 3 elements 54 in a circular layer, in the preferred embodiment each element 54 would be rotated approximately 30° with respect to the previous element and 13 elements 54 would be stacked onto pins 78 to form a first group which would be used for half of ornament 10, a second such group being formed for the completion of ornament 10 as described further below.

Figure 18:
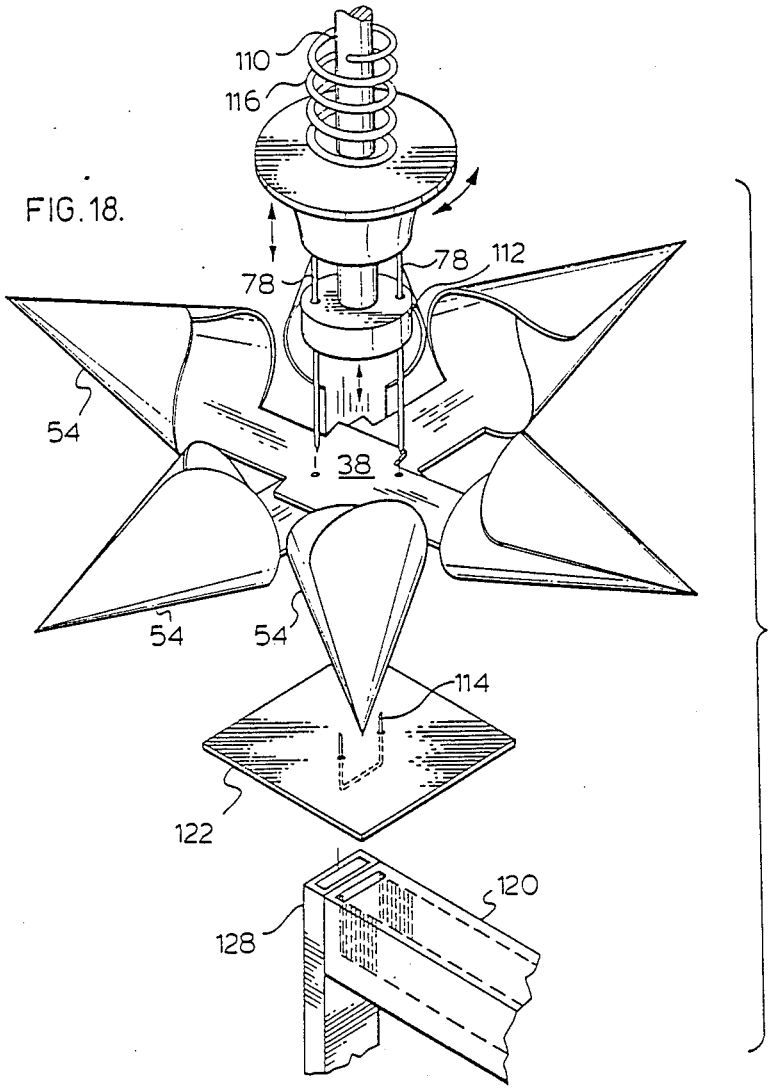
FIG. 18 is an enlarged perspective view showing the stapling of a plurality of elements together.
Figure 19:
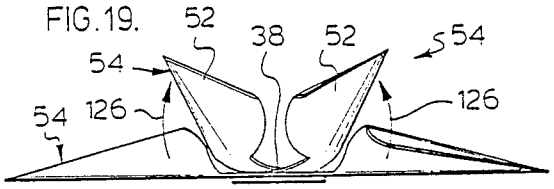
FIG. 19 is an elevational view showing the movement of the cones during the stapling operation.

Referring now to FIGS. 4, 18 and 19, it will be noted that housing 106 has two sets of parallel pins 78 mounted therein. The construction and operation of both sets of parallel pins and their associated structure and stepping drives are identical. Housing 106 is mounted on a pedestal 108 which houses a drive for rotating housing 106 in a step-wise fashion 180° at a time, so that one pair of pins 78 is in position to have a plurality of elements 54 stacked thereon, and the other pair of pins 78 is in position to have one or more groups of elements 54 stapled together as described next below.

FIG. 18 is an exploded view to show how a group of elements 54 is removed from pins 78 and stapled together. Actually, there would typically be 13 elements 54 in a group, FIG. 18 shows only 3 for the purposes of clarity. Associated with each pair of parallel pins 78 is a reciprocating anvil 110 which has a head 112 slidably mounted on pins 78. Head 112 has on its underside a pair of opposed forming grooves (not shown) for bending over the ends of staples 114 as in conventional staplers. A spring 116 biases anvil 110 in the upward position, and where it is desired to strip a set of elements 54 from pins 78, anvil 110 is driven downwardly by a plunger 118 (see FIG. 4). A staple magazine 120, which together with anvil head 112 forms a conventional type stapler or fastening device, is located below the central portions 38 of the stack of elements 54, so that as anvil 110 moves downwardly, it not only strips elements 54 from pins 78 but it engages staple magazine 120 to cause a staple 114 to pierce central portions 38 and thus staple elements 54 together. Prior to this stapling operation, a backing card 122 is inserted under central portions 38, so that it too is also stapled to elements 54. FIG. 4 shows a stack of backing cards 124 in position to feed individual backing cards 122 into position. A suitable magazine and transfer device is used for this purpose, but is not shown in the drawings for the purposes of clarity. Backing cards 122 are of the type used in conventional gift wrap bows being formed of cardboard with an adhesive lower surface with a peel-away protective layer.

FIG. 19 illustrates the action of cones 52 as elements 54 are stapled together, and it will be seen that as the central portions 38 are compressed and stapled together, the cones 52 on the uppermost elements 54 rotate upwardly in the direction of arrows 126. This is what causes ornament 10 to have the radiating conical points in the finished product.

As mentioned above, at the stacking site of stacking and stapling stations 60 adjacent to feed station 58, 13 elements 54 are typically stacked onto pins 78. Housing 106 then rotates 180° functioning as a transfer device to put this group of elements 54 into position to engage staple magazine 120 to be stapled together. This first group of stapled elements 54 is retained on staple magazine 120 by suction produced by a vacuum conduit 128, so that the parallel pins, stepping drive and anvil from which the first group of elements 54 has just been removed is free to be rotated into position to accept another group of elements 54. While the first group of elements 54 is being stapled together, a second group of elements 54 is being stacked onto the opposite set of pins 78. The transfer device or housing 106 is then rotated so that the second group of elements 54 is now positioned over the first group of elements 54 being held on staple magazine 120 by vacuum conduit 128. Plunger 118 then moves downwardly to strip and staple the second group of elements 54 to the first group of elements 54 to complete ornament 10. The negative pressure in vacuum conduit 128 is then reversed, so that positive pressure ejects ornament 10 as indicated by arrow 130 in FIG. 4. It will be appreciated that only one backing card 122 is used with each ornament 10 and this is staped to the first group of elements 54. Also, it will be appreciated that a second staple is used to attach the second group of elements 54 to the first group of elements 54, so that two staples actually pass through the first group of elements 54. In order to do this so that these two staples do not interfere with each other, the first group of elements 54 can be rotated or shifted slighlty before the second stapling operation.

Referring next to FIGS. 4 and 7 through 13, cone forming station 50 will now be described in detail. Petals 36 are formed into cones 52 using a winder 130 and a retractable conical form 132. Winder 130 is split into first and second concentrically rotatable bed elements 134, 136, which together form a conical bed over which petals 36 are positioned to be formed into cones 52. Bed elements 134, 136 are connected to a suitable drive 140 to operate winder 30 as described further below.

Figure 8:
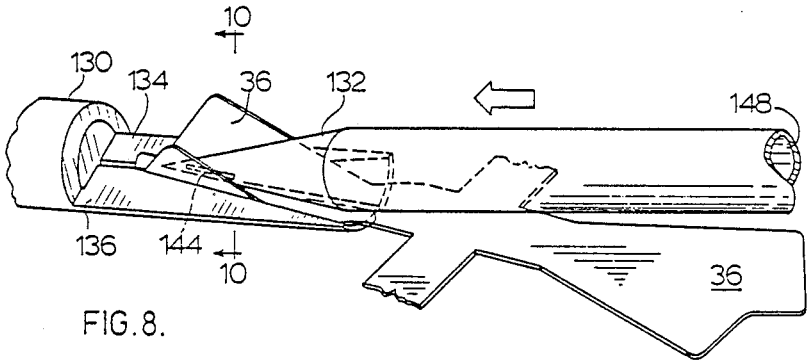

Conical form 132 is shaped to mate with winder conical bed 138 with a petal 36 therebetween as seen best in FIG. 8. It will be appreciated that conical form 132 and winder 130 are on the same axis. A suitable actuator 142 causes conical form 132 to be extended and retracted. Conical form 132 is hollow and is connected alternatively to a source of vacuum and air pressure. A distal slot 144 communicates with the hollow center of form 132 to help in the formation of cones 52 as will be described next below with reference to FIGS. 10 to 13.

When a petal 36 is in position to be wound into a cone as shown in FIGS. 8 and 10, first bed element 134 is rotated counter-clockwise as seen in FIG. 10 wrapping a first or leading edge 146 of petal 36 around conical form 132 to take up the position shown in FIG. 11. At this point, vacuum is applied through the hollow center 148 and slot 144 of conical form 132 to retain the petal leading edge 146 in position. First bed element 134 is then rotated clockwise until it engages second bed element 136 and continues rotating clockwise to thus cause second bed element 136 to rotate clockwise, and this causes second bed element 136 to wrap the second or trailing edge 150 of petal 36 around leading edge 146 as indicated in FIG. 12. This continues to the position shown in FIG. 13 where the cone 52 is completed. At this point, pressure is applied to hollow center 148 and slot 144 as conical form 132 is retracted so that cone 54 is effectively stripped from conical form 132. The adhesive drop 48 applied to trailing edge 150 permanently holds cone 52 together. Conical bed elements 134, 136 and then reset to the position shown in FIG. 7 to repeat the process.

Each winder 130 and conical form 132 forms a cone former combination. FIG. 4 shows one cone former acting on one side of the strip of blanks 40 and a second cone former acting on the opposite side of the strip of blanks 40. Actually, in the preferred embodiment there are 10 such cone formers on each side forming banks of parallel, cone formers and they are spaced apart or arranged longitudinally in registration with the petals 36, and drives 140 and actuators 142 simultaneously operate all of the winders 130 and conical forms 132 in each bank. In the operation of the cone forming station 50, therefore, the strip of blanks 40 is advanced by 10 petals or blanks 34 at a time, strip 40 is stopped while the cones are formed, and strip 40 is again advanced to do the next set of cones. In the preferred embodiment, the petals on either side of strip 40 are wrapped in opposed directions, so that the cones come out identical.

To recap the operation of apparatus 14, a continuous strip of paper is unwound from paper roll 18 and fed through die cutter and anvil rolls 26, 28 to form the continuous strip of blanks 40. This strip 40 is advanced 10 blanks 34 at a time by a suitable conveyor, the banks of cone formers first form the cones on one side of strip 40, and then during the next advance of strip 40 to form the cones on the opposite side of strip 40, thus forming the continuous strip of elements 53. Strip 53 is then walked or transferred through feed station 58 to stacker 82 where a first set of 13 elements 54 is stacked onto the first set of pins 78. Housing 106 is rotated 180°, and while the first set of elements is being stripped from pins 78 and stapled together, the second set of elements 54 is being stacked on stacker 82. Housing 106 is again rotated 180° and the second set of elements 54 is then stripped and stapled to the first set of elements 54 to complete ornament 10.

Having described preferred embodiments of the invention, it will be appreciated that various modifications can be made to the apparatus and methods described. For example, rather than stack elements 54 into two groups or sets and then fasten these two groups together, it is possible to do this all in one operation, especially if it is desired to produce an ornament with fewer points or cones. The banks of cone formers could have more or fewer cone formers in them. Obviously, the size, shape and material from which the cone elements are made could be varied as desired. Also, the various types of drives, conveyors and transfer mechanisms could be changed as well, as will be apparent to those skilled in the art.

From the above, it will be appreciated that the method and apparatus of the present invention results in a fast and economical method of making conically pointed ornaments.

We claim:

1. A method of producing a hemispherically-shaped ornament having a plurality of radiating conical points, the method comprising the steps of:
   providing a strip of flexible material;
   cutting out of said strip a strip of longitudinally spaced-apart blanks, each blank having transversely opposed petals and a central portion therebetween;
   forming said petals into cones to produce elements with opposed cones;
   separating said elements;
   stacking a plurality of said elements in a circular arrangement; and
   compressing and connecting said central portions together.

2. A method as claimed in claim 1 wherein the strip of flexible material is a continuous strip, and wherein said blanks are formed into a continuous strip of blanks with adjacent central portions joined together.

3. A method as claimed in claim 2 wherein the elements are separated by engaging a leading element by the central portion and severing the central portion of said leading element from the central portion of the adjacent element.

4. A method as claimed in claim 3 wherein the elements are stacked by moving said leading element out of the plane of the following element, rotating the leading element and inserting the central portion of the following element under the central portion of the leading element.

5. A method as claimed in claim 3 wherein the central portion is engaged by piercing the central portion transversely with a pair of spaced-apart parallel pins.

6. A method as claimed in claim 4 wherein the central portions of successive elements are moved and rotated by pushing said central portions onto a rotatable pair of transversely disposed, spaced-apart parallel pins.

7. A method as claimed in claim 1 wherein the petals are formed into cones by wrapping the petals around a conical form and adhesively attaching overlapping petal material.

8. A method as claimed in claim 7 wherein a plurality of petals are formed into cones simultaneously by providing a separate conical form for each petal.

9. A method as claimed in claim 4 wherein the elements are connected by stapling together a plurality of stacked central portions.

10. A method as claimed in claim 9 wherein said elements are stapled together into a first group, and further comprising the steps of stacking a second group of elements, stacking said second group onto said first group and stapling together said two groups of elements.

11. A method as claimed in claim 9 and further comprising the step of inserting a backing card under said elements prior to stapling, whereby the elements and backing card are stapled together.

12. A method as claimed in claim 2 wherein the flexible material is paper.

13. Apparatus for producing ornaments having a plurality of radiating conical points comprising:
   a cutter for cutting a strip of longitudinally arranged blanks from a supply of thin flexible material;
   said blanks each having transversely opposed petals and a central portion therebetween;
   a winder having a conical bed adapted to be located below said petals;
   a retractable conical form adapted to mate with the winder conical bed with a petal therebetween;
   an adhesive applicator located before the winder for applying adhesive to said petals;
   means for rotating the winder about the conical form to form the petals into cones;
   means for cutting the continuous strip into elements with opposed cones;
   a stacker for assemblying a plurality of said elements into a circular arrangement with the central portions along a common axis; and
   a fastening device for connecting together the central portions of said elements.

14. Apparatus as claimed in claim 13 wherein the cutter is a rotary die cutter having opposed, spaced-apart blades such that said blanks are formed with successive central portions joined together to form a continuous strip of blanks.

15. Apparatus as claimed in claim 14 wherein said winder and conical form comprise a cone former, and wherein said cone former is one of a bank of parallel, cone formers arranged longitudinally in registration with said petals, and wherein said rotating means includes means for driving said winders simultaneously for the simultaneous formation of a plurality of cones.

16. Apparatus as claimed in claim 15 wherein said bank of cone formers is a first bank of cone formers and is arranged to form a plurality of cones on one side of said continuous strip, and further comprising a second bank of said cone formers arranged to form a plurality of cones on the opposite side of said continuous strip.

17. Apparatus as claimed in claim 15 wherein said winders are split into first and second concentrically rotatable bed elements, and wherein said rotating means includes means for rotating said first and second bed elements successively in opposite directions to form said cones.

18. Apparatus as claimed in claim 13 wherein the stacker includes a rotatable pair of spaced-apart, parallel pins arranged transversely to pierce the central portion of a leading one of said elements, and a pusher for pushing said leading element onto said pins.

19. Apparatus as claimed in claim 18 wherein the cutting means is located to cut the leading element from the continuous strip of elements simultaneously with the leading element engaging the pins.

20. Apparatus as claimed in claim 18 wherein the stacker includes a stepping drive for rotating said pair of pins a predetermined amount before each successive element is pushed onto the pins.

21. Apparatus as claimed in claim 20 wherein the fastening device is a stapler having a staple magazine adapted to be located below the central portions of a stack of elements stacked onto the parallel pins, and a reciprocating anvil located adjacent and parallel to the parallel pins for stripping the stack of elements from the pins and engaging the magazine to staple the elements together.

22. Apparatus as claimed in claim 18 wherein the pusher includes a reciprocating head for engaging and pushing the element central portions onto the parallel pins, and a variable drive for decreasing the travel of the pusher along the pins as each successive element is pushed onto the pins.

23. Apparatus as claimed in claim 13 wherein the stacker includes rotatable pair of spaced-apart, parallel pins adapted to be arranged transversely to pierce the central portions of successive elements, a reciprocating pusher located to push successive elements onto said pins, and a stepping drive for rotating the pair of pins a predetermined amount before each successive element is pushed onto the pins.

24. Apparatus as claimed in claim 23 wherein the fastening device is a stapler having a staple magazine adapted to be located below the central portions of a stack of elements stacked onto the parallel pins, and a reciprocating anvil located adjacent and parallel to the parallel pins for stripping the stack of elements from the pins and engaging the magazine to staple the elements together.

25. Apparatus as claimed in claim 24 wherein the parallel pins, stepping drive and anvil are mounted on a transfer device, and wherein said transfer device includes a second set of parallel pins, stepping drive and anvil, the transfer device including drive means for bringing each set of parallel pins, stepping drive and anvil into operable engagement alternatively with the pusher and staple magazine.

26. Apparatus as claimed in claim 21 and further comprising means for inserting a backing card between the staple magazine and the central portions of the stack of elements prior to stapling the elements together.

* * * * *